US005390437A

United States Patent [19]

Pearson

[11] Patent Number: 5,390,437

[45] Date of Patent: Feb. 21, 1995

[54] ADVERTISING DISPLAY STAND

[75] Inventor: Stephen J. Pearson, Ingleside, Ill.

[73] Assignee: Trend Plastics II, Inc., Round Lake, Ill.

[21] Appl. No.: 27,149

[22] Filed: Mar. 4, 1993

[51] Int. Cl.[6] ..... G09F 3/18

[52] U.S. Cl. ..... 40/661; 40/152.1

[58] Field of Search ..... 40/5, 152.1, 661; 248/165, 444.1

[56] References Cited

U.S. PATENT DOCUMENTS

| | | | |
|---|---|---|---|
| 1,144,341 | 6/1915 | Anderson . | |
| 2,050,136 | 8/1936 | Tucker et al. | 40/152.1 |
| 2,112,583 | 3/1938 | Tucker et al. . | |
| 2,142,826 | 1/1939 | Rosello . | |
| 2,449,911 | 9/1948 | Roth . | |
| 2,833,072 | 5/1958 | Gregory | 40/152.1 |
| 3,029,051 | 4/1962 | Nichols . | |
| 3,086,658 | 4/1963 | Palmer . | |
| 3,956,837 | 5/1976 | Itano . | |
| 4,144,664 | 3/1979 | De Korte | 40/152.1 X |
| 4,217,713 | 8/1980 | Greenberger | 40/611 X |
| 4,594,802 | 6/1986 | Field . | |

FOREIGN PATENT DOCUMENTS

| | | | |
|---|---|---|---|
| 475962 | 11/1937 | United Kingdom | 40/117 |

OTHER PUBLICATIONS

"Safepark" advertising brochure.

*Primary Examiner*—Brian K. Green
*Attorney, Agent, or Firm*—Milton S. Gerstein

[57] ABSTRACT

A display-stand has a separate, clear-plastic base-section defining an upper, horizontal groove off, lot. The display-stand has a separate vertical section, which, in the preferred embodiment, consists of two, vertical, clear-plastic panels. The two panels are inserted through the slot of the base-section, and are held in place by retaining elements integral to the panels themselves, which also force the upper ends of the panels toward each other to firmly retain a printed sheet therein. Each vertical panel also has a sloping, lower surface-portion that contacts against a respective portion of the base-section, whereby the lower surface-portion and the respective, juxtapositioned portion of the base-section sandwich therebetween an advertising display card or paper, which may be replaced upon disassembly of the display-stand.

11 Claims, 7 Drawing Sheets

ADVERTISING DISPLAY STAND

BACKGROUND OF THE INVENTION

The present invention is directed to a display stand for displaying printed advertisement. Typically, the display stand of the invention is used in restaurants, bars, and the like, where the display stand is placed on a table, counter, or the like. The display stand may display in a first, vertical portion a menu, wine list, or any other item required. The base of the stand may be provided with a printed advertisement, such as for a beverage. The vertical portion may also contain an advertisement, if so desired.

The conventional, prior-art type of display stand has a base-section from the upper part of which projects the vertical section which holds the menu, or the like. The conventional stand is formed by cutting a flat, plastic blank from a sheet stock or an injection-molded piece, and then applying heat to the blank at appropriate spots, and then bending and fixturing the piece to create the final, proper and desired shape. The advertisement on the base of the stand cannot be a separate sheet, such as paper, cardboard, and the like, since the base has nothing to accommodate such separate sheets. Thus, the prior-art stand will typically silk-screen, hot stamp, or pad-print the advertisement onto the part of the blank that forms the base of the final display-stand. This advertisement on the base-section of the prior-art display-stand is, therefore, permanent, not capable of being changed.

The present invention provides all of the advantages and benefits of the prior-art display-stand, while providing a great many more advantages and benefits, as set out hereinbelow.

SUMMARY OF THE INVENTION

It is the primary objective of the present invention to provide a display-stand that is made up of a separate base-section and a separate, vertical section.

It is an objective of the present invention to provide such a display-stand that is able to display separate, printed sheets in both the base-section as well as in the vertical section, thus allowing the same display-stand to be used for different advertisement and displays.

It is another objective of the present invention to provide such a display-stand that does not require any heat to be applied, but allows each of the base-section and vertical section to be made separately, as by injection molding, and, thereafter, assembling the base-section and the vertical section together, which assembly is capable of disassembly in order to change the advertisement or printed matter being displayed. This allows the advertisement or printed display to be made of paper, paperboard, cardboard, etc., for the base-section as well as for the vertical section. This allows for a better quality of advertisement, using more colors with better definition at a lower cost, in contrast to printing directly onto the plastic blank, as described above. Printing on paper is must faster, easier, and more capable of automation as compared to printing on plastic blanks. By allowing for the advertisement to be on paper, rather than having to be printed on the plastic blank, any company can provide advertisement by simply making up its own paper advertising sheets, and placing them in the base-section of the display-stand of the invention. In the prior-art stand, owing to the relatively costly and difficult requirements of printing on plastic-blanks, smaller companies shied away from such kind of advertising, since this requires die changes, coordination, and handling problems that make the production of small quantities impractical, and which make mock-up samples very expensive.

It is another objective of the present invention to provide such a display-stand that, since it is made in a separate base-section and vertical section, the display-stand may be shipped either assembled or disassembled. If shipped disassembled, considerable space-savings are gained, and requires less and simpler packaging materials, which are less costly, and also allows a salesman representing the advertiser to carry more in his car or vehicle, without taking up so much space.

It is another objective of the present invention to provide such a display-stand that allows the printed advertising sheets, or cards, that are placed in the base-section for display, to be changed simply, while giving an impression that the display is permanently mounted in the base-section.

It is another objective of the present invention to provide such a display-stand that, since it is made in a separate base-section and vertical section, it lends itself to a much greater variety of shapes and configurations as compared to the heat-bent, prior-art display stand.

Toward these and other ends, the display-stand of the invention has a separate, clear-plastic base-section defining an upper, horizontal groove or slot. The base-section is made separately, as by injection molding, and independent of the vertical section. The display-stand has a separate, vertical section, which, in the preferred embodiment, consists of two, vertical, clear-plastic panels. The two panels are inserted through the slot of the base-section, and are held in place by retaining elements integral to the panels themselves, which also force the upper ends of the panels toward each other to firmly retain a printed sheet therein. Each vertical panel also has a sloping lower surface-portion that contacts against a respective portion of the base-section, whereby the lower surface-portion and the respective, juxtapositioned portion of the base-section sandwich therebetween an advertising display card or paper, which may be replaced upon disassembly of the display-stand.

BRIEF DESCRIPTION OF THE DRAWING

The invention will be more readily understood with reference to the accompanying drawing, wherein.

Figure 21:
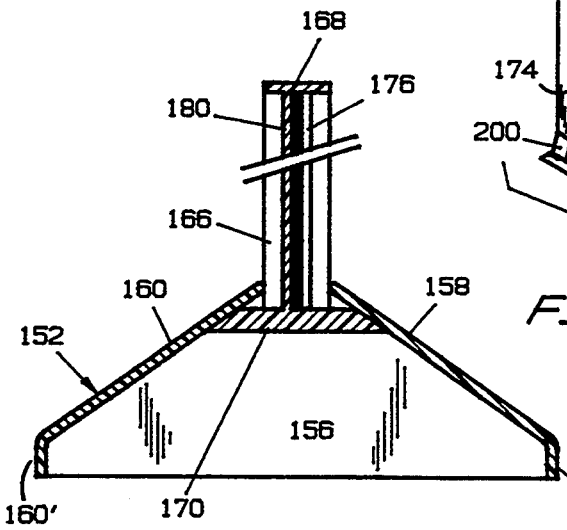

FIG, 20 is an isometric view showing a fourth embodiment of the display-stand of the invention;

FIG. 21 is an assembly, in perspective, thereof; and

Figure 19:
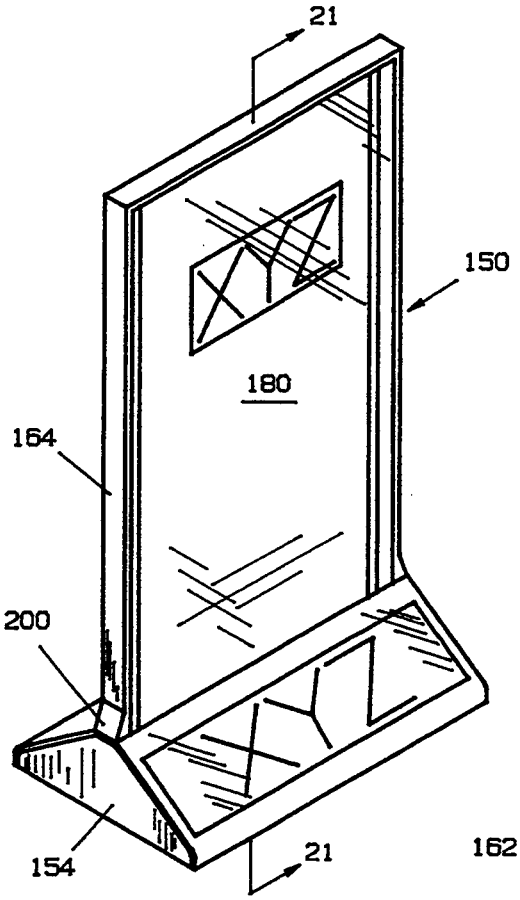

FIG. 22 is a cross-sectional view taken along line 21—21 of FIG. 19.

DETAILED DESCRIPTION OF THE INVENTION

Figure 6:
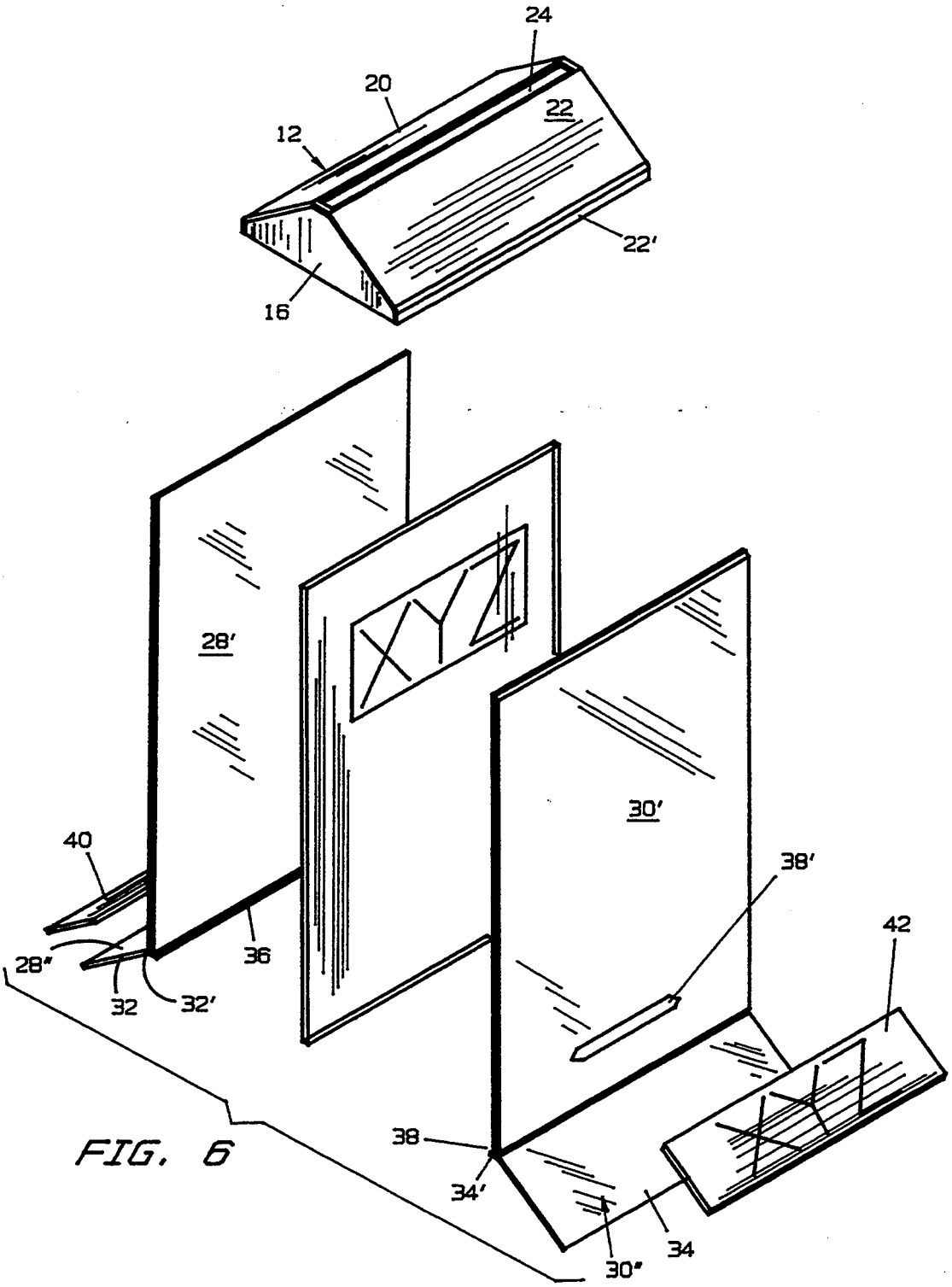
FIG. 6 is an assembly, in perspective, thereof.

Referring now to the drawings in greater detail, and to FIGS. 1–9 for now, the display-stand is indicated generally by reference numeral 10. The display-stand 10 is made up of two basic sections: A horizontal, integral base-section 12, and a vertical, integral panel-section 14 projecting upwardly from the base-section. The base-section 12 has a pair of vertical end-walls 16, 18, and a pair of sloping side walls or surfaces 20, 22 between the end-walls. The side walls converge upwardly toward each other, but they do not meet, in order to form a linear, horizontal slot 24, as best seen in FIG. 6. Each side wall 20, 22 has a lower, or bottom, vertical lip 20', 22', which, in combination with the bottom surfaces of the end-walls, provide a substantially rectangular support-surface for supporting the stand on a surface. The base-section 12 has no bottom cover, so that the hollow interior thereof, and, especially, the linear slot 24, is accessible from below, in order to assemble the panel-section 14, as described hereinbelow. The base-section 12 is made of clear, thermoplastic material, for reasons described below. The base-section is formed as one piece, as by injection molding.

Figure 7:
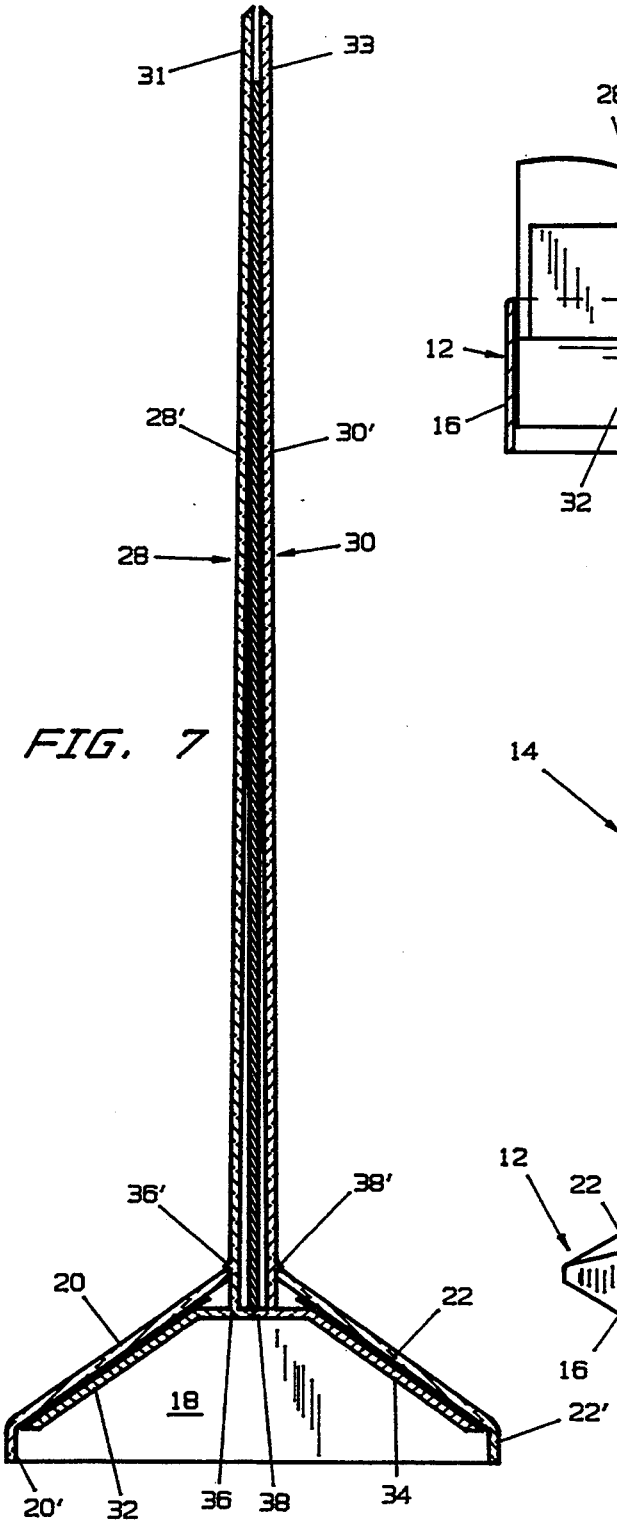
FIG. 7 is a cross-sectional view taken along line 7—7 of FIG. 2.
Figure 8:
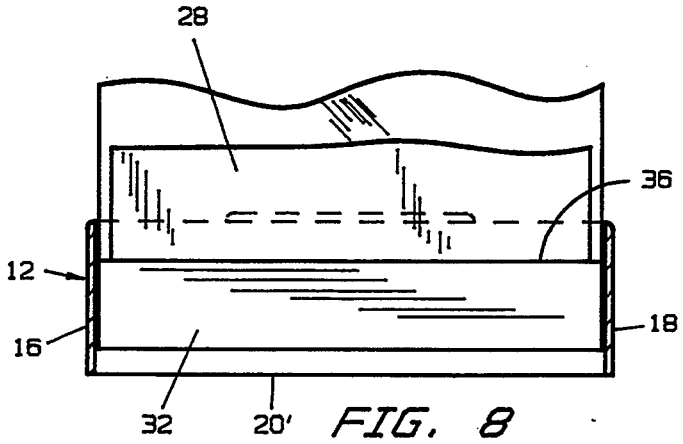
FIG. 8 is a cross-sectional view taken along line 8—8 of FIG. 3.
Figure 9:
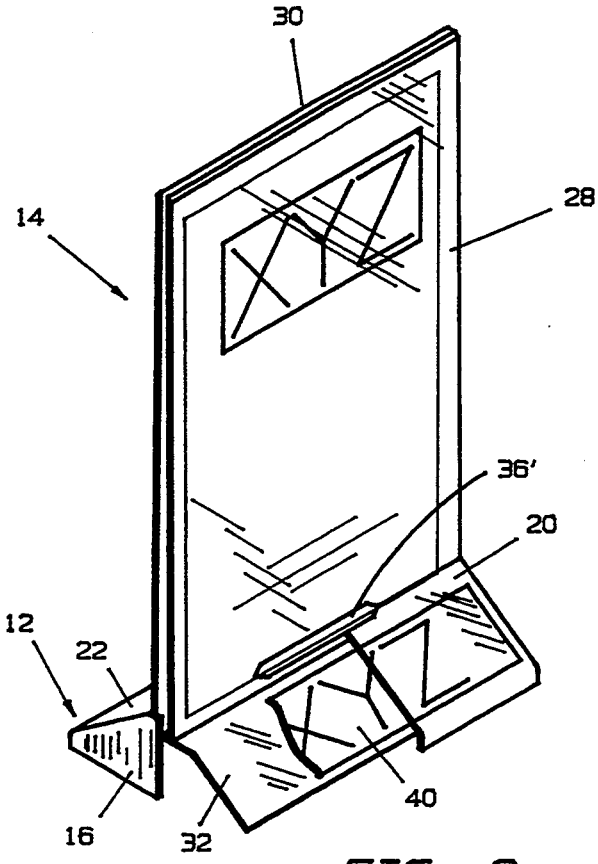
FIG. 9 is an isometric view of the display-stand partially broken away.

The panel-section 14 is made up of two, individual panels 28, 30 which are the mirror-image of each other. As best seen in FIGS. 6 and 7, each panel 28, 30 has a main, vertical portion 28', 30', and a lower, integral portion 28'', 30''. Each lower section is connected to the bottom of its respective vertical portion, and has a sloping surface 32, 34, the angle of slope of each being equal to the angle of slope of the side walls 20, 22, respectively, of the base-section, in order for contact therebetween. From the upper end of the sloping surface 32, 34, there is a horizontal portion 32', 34' to which is actually connected the bottom of the respective vertical portion 28', 30'. Each horizontal portion 32', 34' projects past the respective vertical section to form a projecting rib 36, 38, which, when brought into face-to-face contact with each other, force the sloping surfaces 32, 34 into contact with the side walls 20, 22, as described hereinbelow. Each vertical portion 28', 30' also has a horizontal bead, or rib, 36', 38' projecting from the exterior-facing surface, as seen in FIGS. 6 and 7 Each bead 36', 38' is elevated above the respective, horizontal portion 32', 34' such that, when the base-section and panel-section are assembled, the beads 36', 38' clamp against the upper edge surfaces of the side-walls 20, 22 when the ribs 36, 38 load the sloping surfaces 32, 34 against the side walls 20, 22. These beads are used for preventing the accidental disassembly of the panel-section 14 from the base-section 12. Each panel 28, 30 is made of clear, thermoplastic material, in order to display an advertising card, paper, or the like, inserted between the two vertical portions 28', 30'. Each panel is formed as one piece, as by injection molding.

In order to assemble the base-section and panel-section, in order to display printed matter, or the like, on both the panel-section and on the base-section, a pair of advertising cards 40, 42, having approximately the same shape and size as the sloping surfaces 32, 34, are placed on the exterior-facing surfaces of the sloping surfaces 32, 34, as best seen in FIG. 6, which advertising cards, paper, and the like, will be sandwiched between the side walls and the sloping surfaces when the stand is assembled. Then, the panels 28, 30 are pushed through the open bottom of the base-section, and then through the linear slot 24 until the beads 36', 38' have cleared the slot, and until further movement upward is prevented by contact of the sloping surfaces 32, 34 against the interior surfaces of the side walls 20, 22. Then, the panels are maneuvered until the ribs 36, 38 are forced into face-to-face contact, as seen in FIG. 7, whereupon the sloping surfaces 32, 34 are forced, or loaded, against the side walls 20, 22. When such loading occurs, the beads 36', 38' will be drawn against the upper edges of the side walls 20, 22. When the ribs 36, 38 load the sloping surfaces against the side walls, the upper ends 31, 33, as seen in FIG. 7, will be forced toward each. Pulling the ends 31, 33 apart, a printed brochure, paper, and the like, such as a menu, wine list, etc., may then be inserted between the two vertical portions of the panels 28, 30. Then, after releasing the upper ends 31, 33, they will return to their contacting state by means of the loading ribs 36, 38, thereby firmly holding the printed brochure in place between the panels. Thus, the loading ribs 36, 38 not only removably retain the panel-section in the base-section 12, but they also force the upper ends of the panels against each other for firmly holding the printed brochure. Typically, the brochure or paper will be printed on both sides, so that the same display is seen from either side. It is noted, that, in this embodiment of the invention, the width of the slot 24 will generally pass both panels 28, 30 during assembly, and will easily pass the beads 36', 38' during assembly. After the ribs 36, 38 are forced into face-to-face, loading contact, then the two, vertical sections 28', 30' of the panels are also forced apart, which causes the edges of the slot 24 to be in clamping engagement with the portions of the vertical panel portions juxtapositioned thereat, and which, thus, also effectively increases the distance between the beads 36', 38'. This distance, as measured from tip to tip of the beads 36', 38' is now greater than the width of the slot 24, whereby the beads serve as retaining beads against the upper edge surfaces of the sloping side walls 20, 22.

If the display-stand 10 needs to be disassembled, as, for example, when wanting to change the printed-matter display at the base-section, then one need only squeeze the base-section at the end-walls 16, 18, which will slightly distort the linear slot 24, causing it to widen, which,thus, allows one to clear the beads 36', 38' through the thus-widened slot, allowing the panels to be pulled through the slot, through the hollow interior of the base-section, and out therefrom via the open bottom of the base-section, which is the reverse of the assembly procedure. Since the base-section is made of plastic, such as polystyrene, which is inherently flexible, the squeezing of the end walls will translate into above-mentioned widening of the slot.

Figure 10:
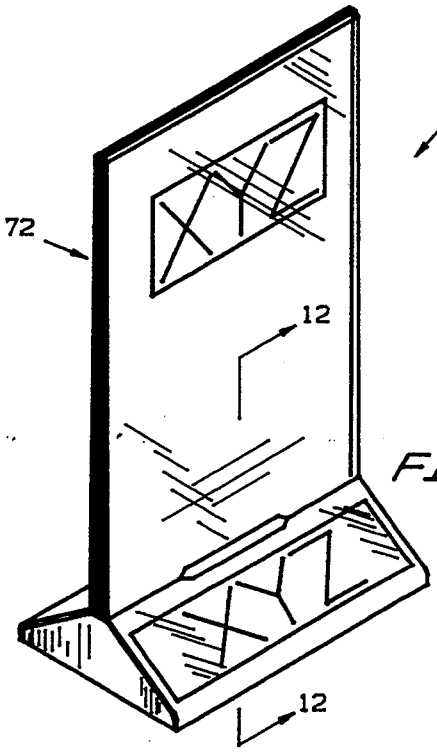
FIG. 10 is an isometric view showing a second embodiment of the display-stand of the invention.
Figure 11:
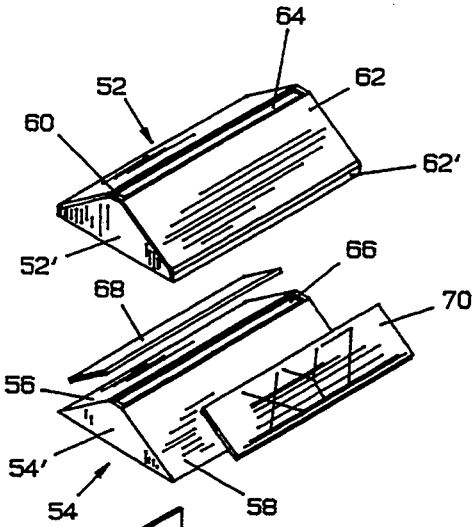
FIG. 11 is an assembly, in perspective, thereof.
Figure 11:
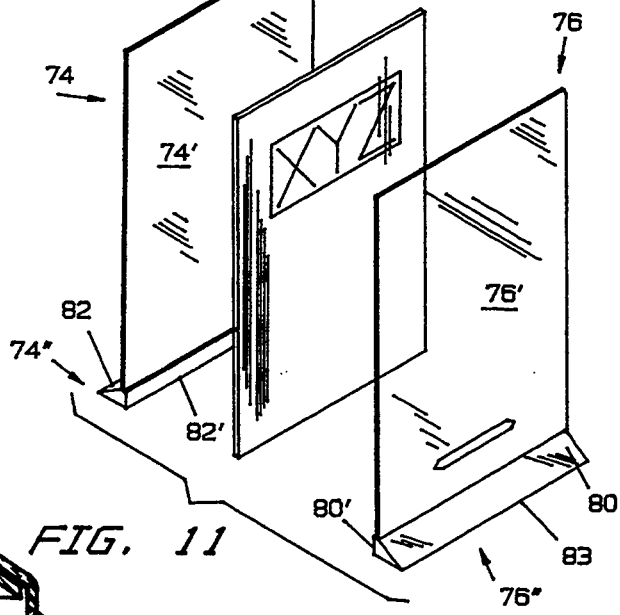
Figure 12:
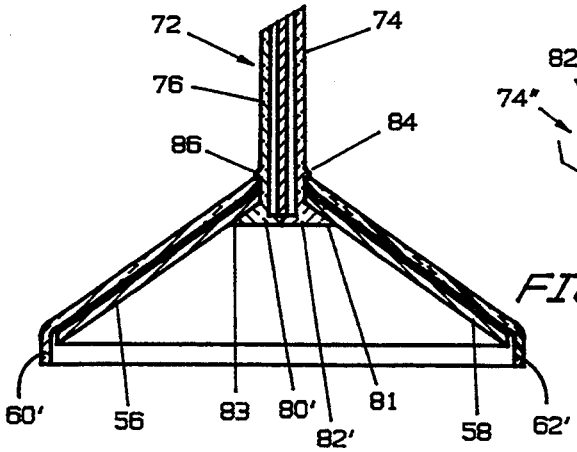
FIG. 12 is a cross-sectional view taken along line 12—12 of FIG. 10.

Referring to FIGS. 10–12, there is shown a second embodiment 50 of the display stand of the invention. In this embodiment, there are provided two base-sections 52, 54, with the base-section 52 being an outer one, and the base-section 54 being the inner one. Each base-section 52, 54, like the base-section 12 of FIG. 1, has a pair end of end-walls 52', 54', respectively, a pair of sloping side surfaces 56, 58 and 60, 62, respectively, and a linear slot 64, 66, respectively. The in inner base-section is slightly smaller in cross section, order to fit inside the outer base-section. The sloping side surfaces of the two base-sections have the same angle of slope. The only other difference between the two base-sections is that the sloping side surfaces 60, 62 of the outer base-section have vertical sections 60', 62' for providing a lower supporting surface for supporting the stand on a surface. Before the two base-sections 52, 54 are placed together, advertising cards are placed against the sloping side surfaces 56, 58, so that they are sandwiched between the sloping side surfaces of the inner base-section and the sloping side surfaces of the outer base-section, as best seen in FIG. 10.

The stand 50 has a vertical panel-section 72 made up of two panels 74, 76 which are the mirror-image of each other. Each panel 74, 76 is similar to the panels of the first embodiment of FIG. 1, with the exception that the panels 74, 76 are not provided with long, lower side walls. Each panel 74, 76 has a main vertical portion 74', 76', and a lower, securing portion 74", 76". Each lower, securing has an exterior-facing canted wall-surface 80, 82 that matches the slope of the sloping interior of the side walls 56, 58 of the inner base-section 54, as best seen in FIG. 12. Each lower, securing portion also has an inwardly-projecting rib 80', 82' which project interiorly beyond the interior surface of the respective, vertical portion 74', 76' of the panels The ribs 80', 82' define vertical, flat surfaces that, when forced into face-to-face contact, load, or force, the canted walls 80, 82 against the juxtapositioned interior portions of the sloping side walls 56, 58, which loading also causes the sloping side walls 56, 58 against the sloping side walls 60, 62 of the outer base-section, whereby the two base-sections 52, 54 are firmly, yet removably, secured together. The distance from the tip-edge 81 of the canted wall 80 to the tip-edge 83 of the canted wall 82, when the panels 74, 76 are mounted together in the base-sections, is greater than the corresponding dimension in the interior of the inner base-section where the canted walls 80, 82 are positioned, so as to provide the force-fit, friction-type of clamping retention for holding the base-sections with the panel section together. Each panel also has a bead in order to prevent the accidental disassembly of the arrangement, as described above for the embodiment of FIG. 1 The ribs 80', 82' also load the upper ends of the vertical sections in order to force them into clamping contact, in order to firmly hold a brochure therein. When it is desired to disassemble the parts, the end walls 52' of the outer base-section are squeezed toward each other by fingers of one hand, thus widening the slots 64, 66, allowing the beads to 84, 86 to clear and drop through the slots. This disassembly allows for different advertising cards 68, 70 to be inserted and displayed.

Figure 15:
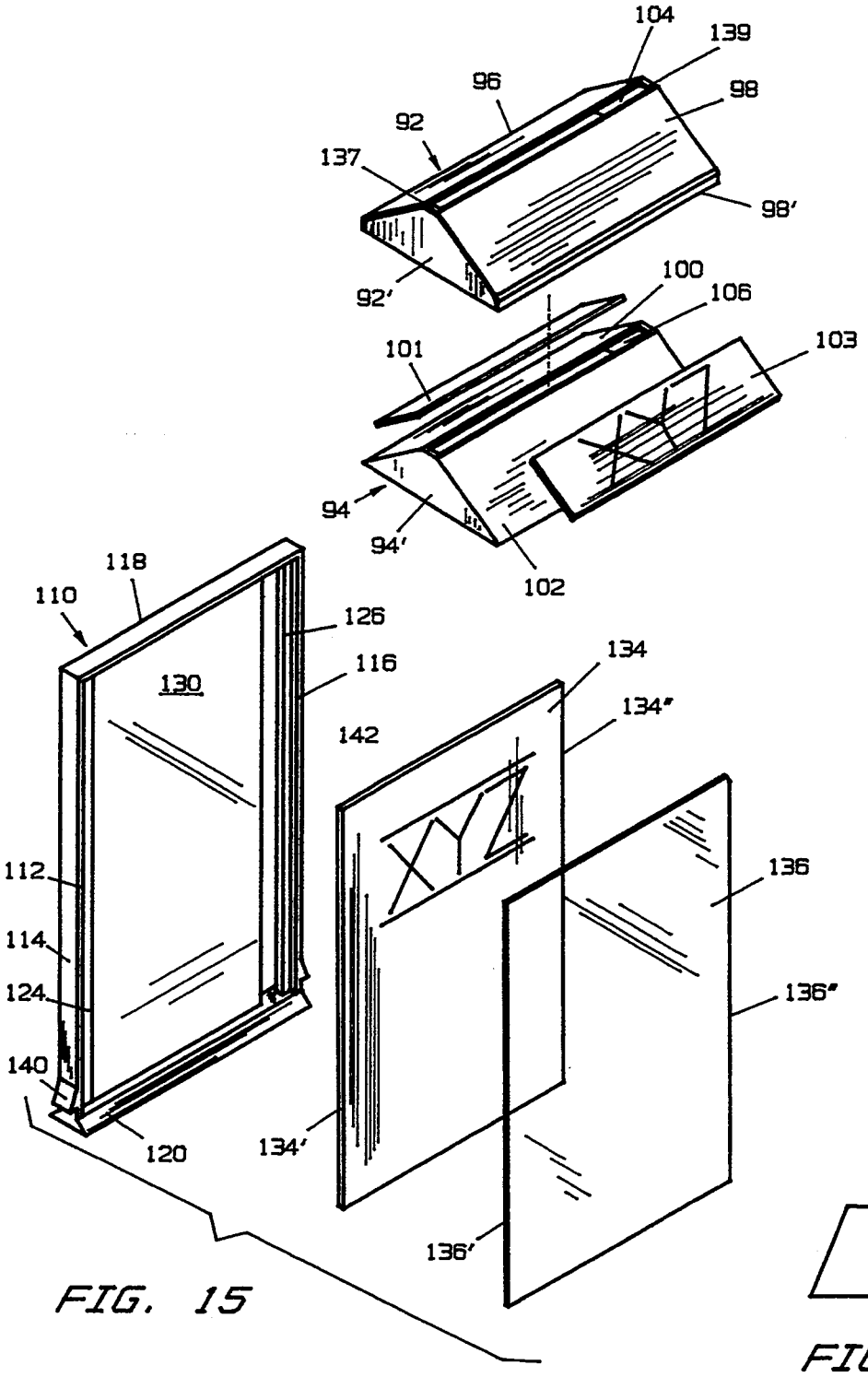
FIG. 15 is an assembly in perspective thereof.

Referring to FIGS. 13–18, there is shown a third embodiment 90 of the display stand of the invention. In this embodiment, there are provided two base-sections 92, 94, as in the second embodiment of FIG. 10, with the base-section 92 being an outer one, and the base-section 94 being the inner one Each base-section 92, 94, has a pair end of end-walls 92', 94', respectively, a pair of sloping side surfaces 96, 98 and 100, 102,respectively, and a linear slot 104, 106, respectively. The inner base-section is slightly smaller in cross section, in order to fit inside the outer base-section. The sloping side surfaces of the two base-sections have the same angle of slope. The only other difference between the two base-sections is that the sloping side surfaces of the outer base-section have vertical sections 96', 98' for providing a lower supporting surface for supporting the stand on a surface. Before the two base-sections are placed together, advertising cards 101, 103 are placed against the sloping side surfaces 100, 102, so that they are sandwiched between the sloping side surfaces of the inner base-section and the sloping side surfaces of the outer base-section, as best seen in FIG. 15.

Figure 1:
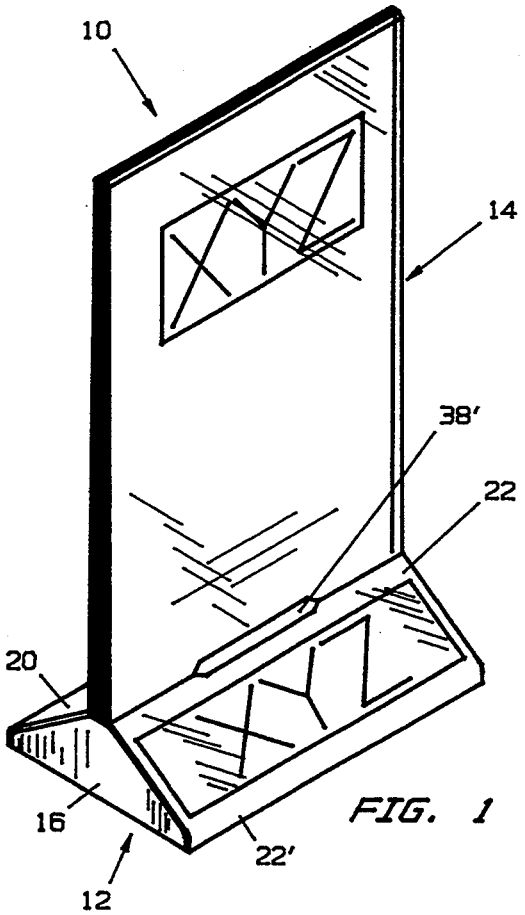
FIG. 1 is an isometric view of the display-stand of the invention.
Figure 2:
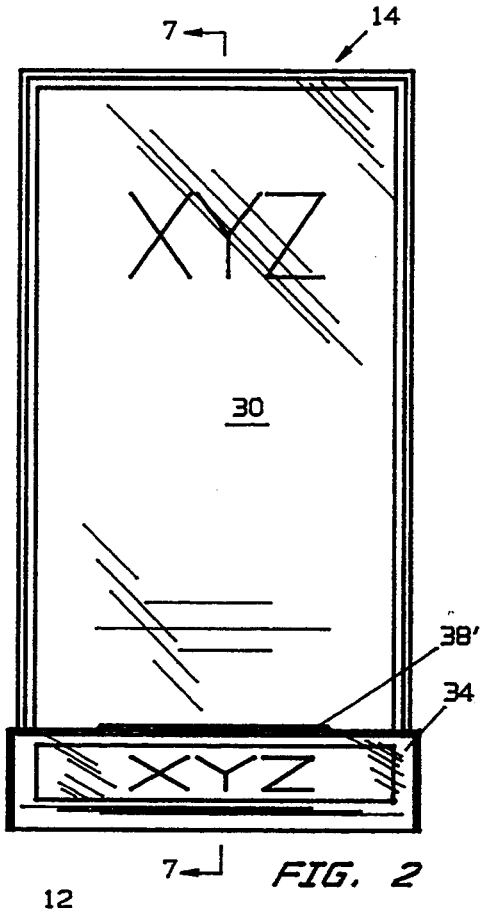
FIG. 2 is a front view thereof.
Figure 3:
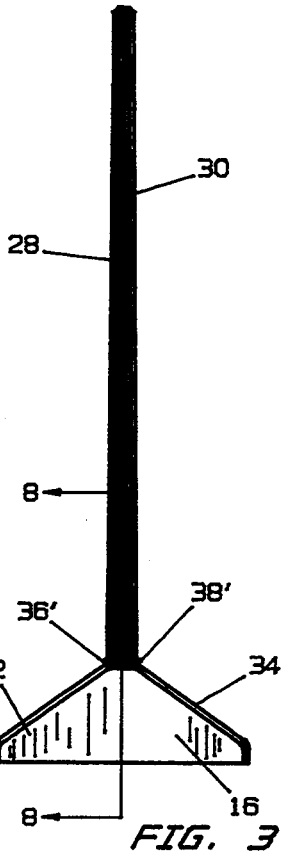
FIG. 3 is a side elevational view thereof.
Figure 4:
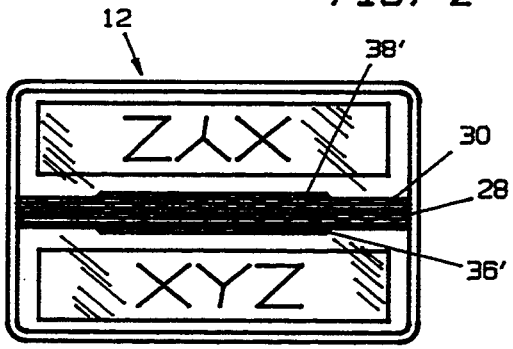
FIG. 4 is a bottom view thereof.
Figure 5:
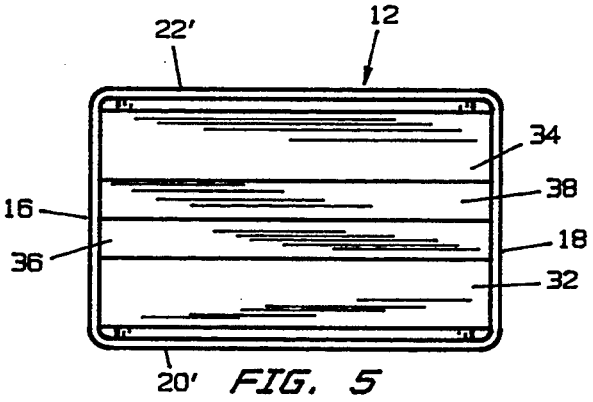
FIG. 5 is a top view thereof.

The display-stand 90 has a vertical section 110, which, unlike the embodiments of FIGS. 1 and 10, is comprised of only one, integral panel 112. The panel 112 is substantially rectangular in cross section, and has a border made up of side walls 114, 116, top wall 118, and bottom wall 120. Each of the side walls 114, 116 and top wall 110 are of substantially the same width, as seen when viewing FIG. 15, while the bottom wall 120 has a greater width, in order to aid in the removable securement of the panel-section to the base-sections, as described hereinbelow. The panel 112 has a pair of eoppositely-disposed, vertical, narrow partitions 124, 126 extending from the interior surfaces of the side walls 114, 116, respectively. Each partition has only a thin thickness, and is located closer to the front of the panel than the back of the panel, which front of the panel is that which is seen in FIG. 15. Operatively associated with these partitions is a central, relatively wide partition 130 that has an upper edge connected to the interior of the upper wall 118, and a lower edge connected to the interior of the bottom wall 120. The wide partition 130 has a width that is approximately equal to the open space between the interior edges of the narrow partitions 124, 126. The wide partition 130 is located approximately in the center of the panel, or farther away from the front of the panel than the narrow partitions 124, 126, whereby a gap is provided between vertical surfaces of the narrow partitions facing in the direction toward the wide partition and the vertical surface of the wide partition facing toward the front of the panel. Thus, the narrow partitions 124, 126 lie in a vertical plane closer to the front of the panel as compared to the vertical plane of the wide partition, as can best be seen in FIG. 21. By this arrangement, a printed brochure, paper, 134, or the like, may displayed. The paper 134, and its separate, clear-plastic cover 136, are is held in place in the panel by inserting the edge surfaces 134' and 136' thereof in the gap between one edge of the wide partition 130 and the edge of the adjacent narrow partition 124, and the edge-surfaces 134" and 136" in the gap between the other edge of the wide partition 130 and the edge of the adjacent narrow partition 126. Since the width of the printed brochure 134 and its plastic covering is greater than the width of the wide partition 130, they will be retained in the panel by means of the narrow partitions 124, 126, whereby they will be sandwiched between the wide partition 130 and the two narrow partitions 124, 126. The plastic, protective covering 136 is provided, since, without it, the printed display would be exposed and uncovered by the open space between the two narrow partitions 124, 126.

Figure 15A:
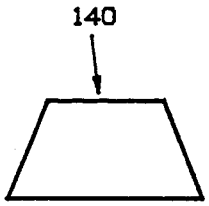
FIG. 15A is a pnal view of a camming member associated with the side walls of the panel.

Each side wall 114, 116 of the panel 110 is provided with a detent 140, 142, respectively, that will contact against the flat, upper surfaces 137, 139 of the end-walls 92' of the outer base-section 92 for retaining the panel to the base-sections. The wider bottom wall 120 has a width greater than the width of the slots 104, 106, so that, when the panel is forced upwardly through the slots, via the open bottoms of the base-sections, the bottom wall 120 prevents further passage through the slots. Each detent 140, 142 increases in width from the top to the bottom thereof, to define a trapezoidal shape, as shown in FIG. 15A. The top width of each detent is slightly less then the width of the slots, in order to allow initial entry of the tops of the detents into the slots. As the panel 110 is slid up through the slots, the detents will enter into the slots, and, as the panel is forced upwardly, the ever-widening detents will force the slots to widen in order to accommodate passage of the detents therethrough. After the detents have cleared the slots, the slots will return to their original width, whereby the detents 140, 142 prevent disassembly. It is noted that the width of each of the side walls 114, 116 at their portions directly below the detents 140, 142, respectively, may be enlarged, so that, after the detents have cleared the slots, allowing the slots to return to a narrow size, the slots will grip these enlarged portions, to provide an even tighter retention of the panel with the base-sections.

Figure 16:
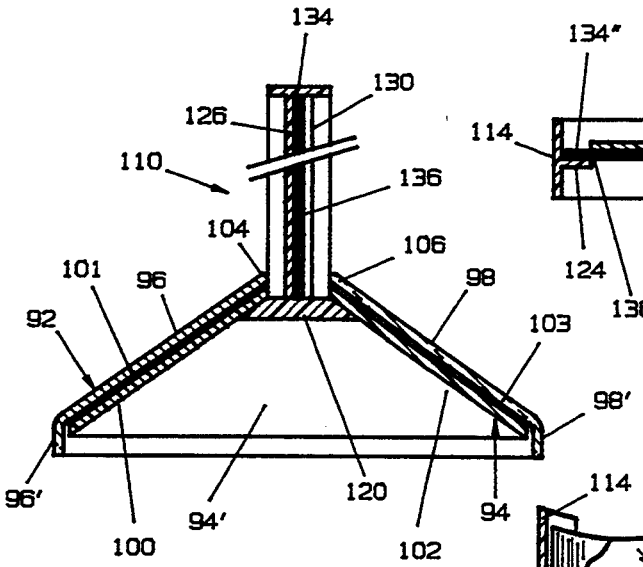
FIG. 16 is a cross-sectional view taken along line 16—16 of FIG. 13.
Figure 17:
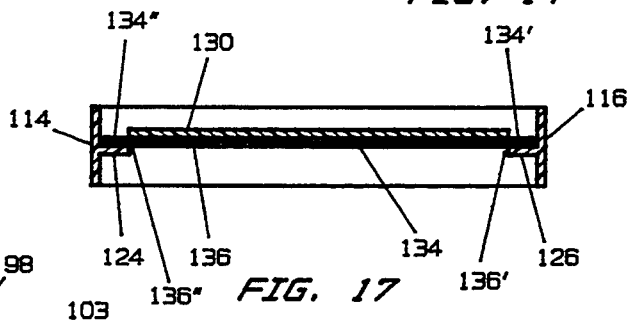
FIG. 17 is a bottom, cross-sectional view through the panel thereof.
Figure 18:
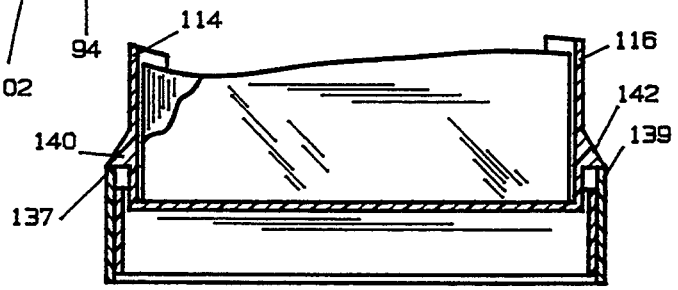
FIG. 18 is a front, cross-sectional view showing the attachment of the panel to the base.
Figure 20:
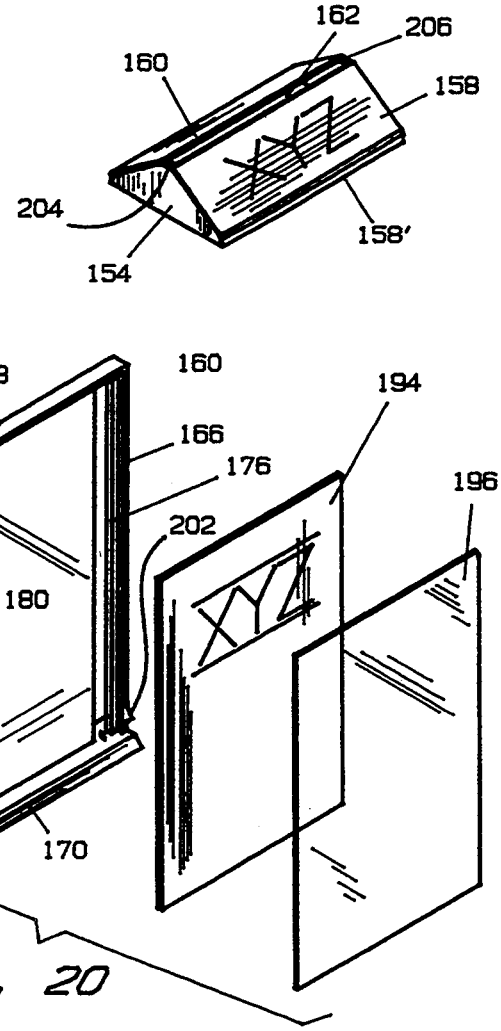

Referring to FIGS. 19–21, there is shown a fourth embodiment 150 of the display stand of the invention. This embodiment is a combination of the base-section of the embodiments of FIG. 1 and the panel-section of the embodiment of FIG. 20. Thus, the base-section 152 has a pair of vertical end-walls 154, 156, and a pair of sloping side walls or surfaces 158, 160 between the end-walls. The side walls converge upwardly toward each other, but they do not meet, in order to form a linear, horizontal slot 162, as best seen in FIG. 16. Each side wall 158, 160 has a lower, or bottom, vertical lip 158', 160', which, in combination with the bottom surfaces of the end-walls, provide a substantially rectangular support surface for supporting the stand on a surface. The base-section 152 does not have a bottom cover, so that the hollow interior thereof, and, especially, the linear slot 162, is accessible from below, in order to assemble the panel-section. The base-section 152 is made of clear, thermoplastic material. The base-section is formed as one piece, as by injection molding.

Figure 13:
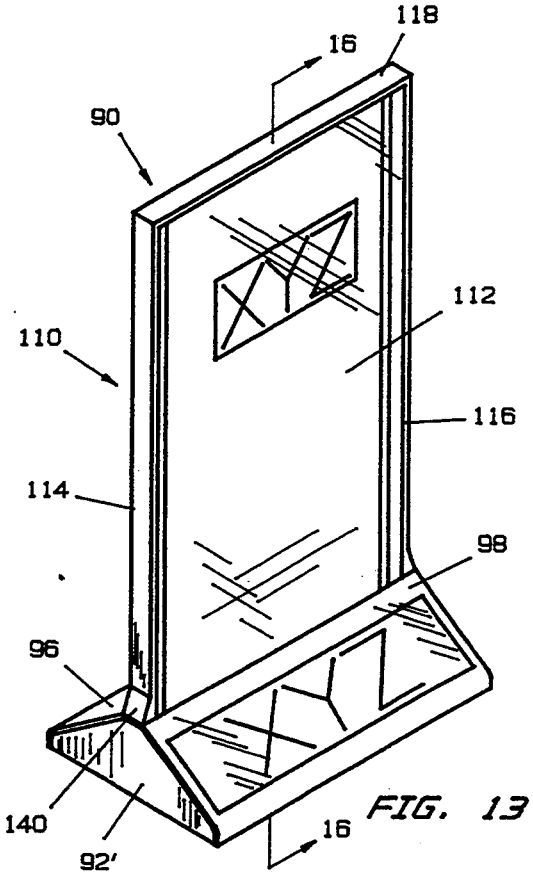
FIG. 13 is an isometric view showing a third embodiment of to display-stand of the invention.
Figure 14:
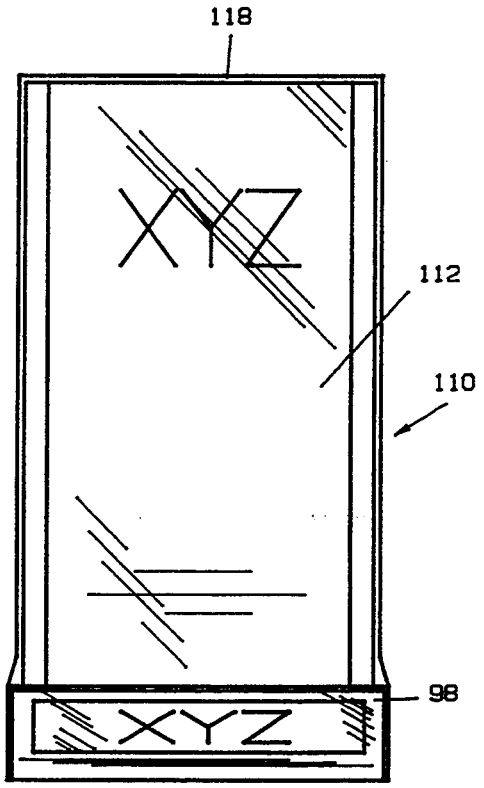
FIG. 14 is front view thereof.

The display-stand 150 has a vertical section 160, similar to the embodiment of FIG. 13, and is comprised of only one, integral panel 162. The panel 162 is substantially rectangular in cross section, and has a border made up of side walls 164,166, top wall 168, and bottom wall 170. Each of the side walls 164, 166 and top wall 168 are of substantially the same width, as seen when viewing FIG. 20, while the bottom wall 170 has a greater width, in order to aid in the removable securement of the panel-section to the base-section, as described hereinbelow. The panel 162 has a pair of oppositely-disposed, vertical, narrow partitions 174, 176 extending from the interior surfaces of the side walls 164, 166, respectively. Each partition has only a thin thickness, and is located closer to the front of the panel than the back of the panel, which front of the panel is that which is seen in FIG. 20. Operatively associated with these partitions is a central, relatively wide partition 180 that has an upper edge connected to the interior of the upper wall 168, and a lower edge connected to the interior of the bottom wall 170. The wide partition 180 has a width that is approximately equal to the open space between the interior edges of the narrow partitions 174, 176. The wide partition 180 is located approximately in the center of the panel, or farther away from the front of the panel than the narrow partitions 174, 176, whereby a gap is provided between vertical surfaces of the narrow partitions facing in the direction toward the wide partition and the vertical surface of the wide partition facing toward the front of the panel. Thus, the narrow partitions 174, 176 lie in a vertical plane closer to the front of the panel as compared to the vertical plane of the wide partition, as can best be seen in FIG. 21. By this arrangement, a printed brochure, paper, 194, or the like, may displayed. The paper 194, and its separate, clear-plastic cover 196, are is held in place in the panel by inserting the edge surfaces thereof in the gap between one edge of the wide partition 180 and the edge of the adjacent narrow partition 174, and in the gap between the other edge of the wide partition 180 and the edge of the adjacent narrow partition 176. Since the width of the printed brochure and its plastic covering is greater than the width of the wide partition 180, they will be retained in the panel by means of the narrow partitions, whereby they will be sandwiched between the wide partition 180 and the two narrow partitions 174, 176.

Each side wall 164, 166 of the panel 162 is provided with a detent 200, 202, respectively, that will contact against the flat, upper surfaces 204, 206 of the end-walls 154 of the base-section 152 for retaining the panel to the base-section. The wider bottom wall 170 has a width greater than the width of the slot 162, so that, when the panel is forced upwardly through the slot, via the open bottom of the base-section, the bottom wall 170 prevents further passage through the slot. Each detent 200, 202 increases in width from the top to the bottom thereof, to define a trapezoidal shape, as shown in FIG. 15A. The top width of each detent is slightly less then the width of the slots, in order to allow initial entry of the tops of the detents into the slot. As the panel is slid up through the slot, the detents will enter into the slot, and as the panel is forced upwardly, the ever-widening detents will force the slot to widen in order to accommodate passage of the detents therethrough. After the detents have cleared the slot, the slot will return to their original width, whereby the detents 140, 142 prevent disassembly. It is noted that the width of each of the side walls 174, 176 at their portions directly below the detents may be enlarged, so that, after the detents have cleared the slots, allowing the slots to return to a narrow size, the slots will grip these enlarged portions, to provide an even tighter retention of the panel with the base-sections.

While the above-embodiments have been shown as being vertically oriented for support on a horizontal surface, it is within the scope and purview of the invention to provide a display-stand that may be arranged horizontally or angularly. Alternatively, the panel section may extend from the base-section at an angle with respect to the vertical, as by providing a linear slot in base section in a surface that forms an angle with respect to the horizontal. In this instance, the shape of the base-section need not be trapezoidal. Moreover, in regards to the embodiment of FIG. 1, it is possible to eliminate the beads 36, 38.

What I claim:

1. A display stand comprising:

a base-section having a display-panel support-surface means for securing a display-panel means, said display-panel support-surface means having a slot formed therein; and display-panel means for displaying printed matter projecting upwardly through said slot of said display-panel support-surface means, said display-panel means comprising a pair of panels and retaining means for securing said panels to said base-section;

said display-panel support-surface means comprising a first, sloping side-wall and a second, sloping side wall, each of said first and second side walls having a first, lower end and a second upper end, said second upper ends converging toward each other, each said side wall forming an angle; said slot being formed between said second upper ends;

each of said pair of panels having a first, main portion for printed matter, said first main portion having a first end and a second end, and a second portion extending at an angle with respect to said first main portion, said second portion having a first end connected to said second end of said first main portion, and a second end; each said second portion comprising at least a portion thereof extending at an angle relative to said first main portion substantially equal to the angle of one of said first and second side walls, each said second portion being juxtapositioned opposite a respective one of said first and second side walls.

2. The display stand according to claim 1, wherein said retaining means for securing said display-panel means to said base-section comprises a first rib formed at said first end of said second portion of a first one of said pair of panels, and a second rib formed at said first end of said second portion of the other of said pair of panels, said first and second ribs being opposite to each other for mating contact for loading said second portions against said first and second side walls, whereby, after said panels have been inserted through said slot, said second portions are forced apart in order to force said ribs into face-to-face contact, said ribs, when engaged with each other, causing said first ends of said first portions toward each other, whereby printed matter inserted between said first portions is firmly held.

3. The display stand according to claim 2, wherein said retaining means for securing said display-panel means to said base-section further comprises a third rib formed in said first portion of a first one of said pair of panels, and a fourth rib formed in said first portion of the other of said pair of panels, said third and fourth ribs being located relative to said slot oppositely to said first and second ribs in order to prevent said panels from being accidentally disassembled from said base-section.

4. The display stand according to claim 1, wherein said base-section is made of clear plastic, and each of said pair of panels is made of clear plastic; said base-section further comprising a first and a second advertising card, said first card being inserted between said first side wall and its associated, respective said second portion of one of said pair of panels, and said second card being inserted between said second side wall and its associated, respective said second portion of the other of said pair of panels, whereby said cards may be easily inserted and removed, and replaced with different advertising cards.

5. The display stand according to claim 1, further comprising an additional base-section comprising a third, sloping side wall and a fourth sloping side wall, each of said third and fourth side walls having a first, lower end and a second upper end, said second upper ends converging toward each other; and another slot between said second, upper ends of said of said third and fourth side walls; said third wall being in abutting contact against said first side wall, and said fourth side wall being in abutting contact against said second side wall; said display-panel means passing through both said slot and said another slot.

6. A method of assembling a display stand, the display stand comprising a hollow-interior base-section having an open bottom, said base-section having a slot formed therein; and display-panel means for displaying a printed matter capable of projecting upwardly through said slot, said display-panel means comprising at least one panel and having a first upper section having an upper end and an enlarged second lower section, and retaining means capable of securing said display-panel means to said base-section, said method comprising the following steps:

(a) inserting said first upper end of said upper section of said display-panel means through said open bottom and hollow-interior of said base-section, and then through said slot until said enlarged second section prevents further passage through said slot;

(b) removably retaining said display-panel means in said base-section via said retaining means.

7. The method according to claim 6, wherein said step of removably retaining said display-panel means comprises pushing said retaining means through said slot.

8. The method according to claim 6, further comprising disassembling said display-panel means from said base-section, said step of disassembling comprising squeezing said base-section in order to enlarge said slot, and pulling said display-panel means out through said slot and through said bottom.

9. A display stand comprising:

a base-section having a display-panel support means for securing a display-panel means, said display-panel support means having a through-slot formed therethrough, said through-slot having a length; and display-panel means for displaying printed matter comprising an upper section extending above said through-slot, said upper section having a width less than said length of said through-slot so that said upper section may pass through said through-slot, a middle section passing through said through-slot, and an enlarged lower section extending below said through-slot, said enlarged lower section being normally impassable through said through-slot; and retaining means for securing said display-panel means to said display-panel support means of said base-section;

said display-panel support means comprising a first, sloping side wall and a second, sloping side wall; each of said first and second side walls having a first, lower end and a second upper end, said second upper ends converging toward each other; said through-slot being formed between said second, upper ends;

said display-panel support means comprising an open bottom defined between said first, lower ends of said first and second side walls, said display-panel support means comprising a substantially hollow interior, whereby said display-panel means is inserted through said through-slot via said open bottom, by inserting said upper section through said open bottom, through said hollow interior, and through said through-slot, said enlarged lower section preventing complete passage through said through-slot;

each of said first and second sloping side walls comprising an interior surface; said enlarged lower section comprising a first sloping side surface in abutting juxtaposition against said interior surface of said first sloping side wall, and a second sloping side surface in abutting juxtaposition against said interior surface of said second sloping side wall;

said retaining means comprising a camming member formed in said one lower section and extending toward the other said lower section, and a second camming member formed in said other lower section and extending toward said one lower section, said first and second camming members being substantially colinear with each other and forcing said first and second side surfaces apart into abutting contact with said first and second side walls, respectively.

10. The display stand according to claim 9, wherein said retaining means for securing said display-panel means to said base-section further comprises a first rib formed in said upper section of said first one of said pair of panels, and a second rib formed in said upper section of the other of said pair of panels, said first and second ribs being located on the side of said through-slot opposite to the side at which said first and second camming members are located in order to prevent said panels from being accidentally disassembled from said base-section.

11. The display stand according to claim 21, wherein said base-section is made of clear plastic; said base-section further comprising a first and a second advertising card, said first card being inserted between said first side surface and said first side wall, and said second card being inserted between said second side surface and said second wall, whereby said cards may be easily inserted and removed, and replaced with different advertising cards.

* * * * *